US010766250B1

(12) United States Patent
Lewis et al.

(10) Patent No.: US 10,766,250 B1
(45) Date of Patent: Sep. 8, 2020

(54) PRINT CONTROLLER AND METHOD OF PRINTING

(71) Applicant: Xyrec IP B.V., Shiphol-Rijk (NL)

(72) Inventors: Christopher L. Lewis, Helotes, TX (US); Matthew M. Robinson, San Antonio, TX (US); Paul T. Evans, San Antonio, TX (US); Peter Boeijink, Schiphol-Rijk (NL); Branson P. Brockschmidt, San Antonio, TX (US)

(73) Assignee: Xyrec IP B.V., Schiphol-Rijk (NL)

( * ) Notice: Subject to any disclaimer, the term of this patent is extended or adjusted under 35 U.S.C. 154(b) by 0 days.

(21) Appl. No.: 16/282,412

(22) Filed: Feb. 22, 2019

(51) Int. Cl.
*B41J 2/045* (2006.01)
*B41J 2/18* (2006.01)

(52) U.S. Cl.
CPC ..... *B41J 2/04508* (2013.01); *B41J 2/04581* (2013.01); *B41J 2/18* (2013.01); *B41J 2/04526* (2013.01)

(58) Field of Classification Search
CPC ..... B41J 2/04508; B41J 2/18; B41J 2/04581; B41J 2/04526
See application file for complete search history.

(56) References Cited

U.S. PATENT DOCUMENTS

2016/0355026 A1 12/2016 Mathis et al.

FOREIGN PATENT DOCUMENTS

WO 2016/066208 A1 5/2016

*Primary Examiner* — Justin Seo
(74) *Attorney, Agent, or Firm* — N. V. Nederlandsch Octrooibureau; Catherine A. Shultz; Katelyn J. Bernier

(57) ABSTRACT

The invention relates to a printing device for printing large countoured three-dimensional objects. The printing device comprises a movable robot arm mounted on a movable support, a printhead supported at a printing end of the robot arm, the print head comprising a plurality of nozzles, an ink reservoir connected to the nozzles of the print head and to a pump device for supplying ink from the reservoir to the nozzles, and a controller for moving the print head along a printing trajectory while changing the orientation of the printhead. The controller is arranged for:

in a calibrating step moving the print head along a calibration trajectory and measuring ink pressures in the printing head and generating and storing ink pressure control data for the nozzles for different orientations of the print head, and in a printing step generating for varying orientations of the printhead along the printing trajectory a pressure control signal on the basis of the stored ink pressure control data, which pressure control signal is supplied to the pump device such that a pressure of the ink in the nozzles is set at a predetermined pressure value.

12 Claims, 2 Drawing Sheets

PRINT CONTROLLER AND METHOD OF PRINTING

FIELD OF THE INVENTION

The invention relates to a printing device comprising a movable robot arm mounted on a movable support and a print head supported at a printing end of the robot arm.

The invention also relates to a method of printing an object with a print head supported on a movable robot arm, in particular large three-dimensional contoured objects.

BACKGROUND OF THE INVENTION

US 2016/0355026 describes a large robot system for printing on the hull or on the wings of an aircraft. A robot arm moves the print head, that may be configured as an inkjet printer, in overlapping swaths of varying intensity across the aircraft's complex geometry.

In WO2016/066208 an inkjet printer is described with primary ink tanks that are in fluid communication with nozzles of the movable print head that is situated on a sliding carriage unit. A pump connected to the primary ink tanks is controlled by a controller to supply ink to the print head from the primary ink tanks through an ink delivery circuit. By combining the relative movements of the carriage unit along a transverse scan direction and the feed of the print medium in the medium advance direction, each print head can deposit ink on individual pixel locations on the print medium. A pressure sensor is coupled to the primary ink tanks to determine the fill level of each tank. When the pressure pattern observed by the pressure sensor in a primary ink tank drops below a predetermined threshold, the controller activates a secondary ink tank for supply of additional ink to the primary ink tank for refilling.

The known inkjet printer is not adapted to print on complicated three-dimensional print surfaces. This is especially true for printing at a relatively high resolution and speed (200 dots-per-inch and 250 mm/s) while varying the orientation of the print head. Such conditions require an accurate control of the printing conditions.

It is therefore an object of the invention to provide an ink jet printer and method of printing that are particularly suitable for accurately and rapidly printing on complex three-dimensional print surfaces.

SUMMARY OF THE INVENTION

Hereto the printing device according to the invention comprises:

- a movable robot arm mounted on a movable support,
- a print head supported at a printing end of the robot arm, the print head comprising a plurality of nozzles,
- an ink reservoir connected to the nozzles of the print head and to a pump device for supplying ink from the reservoir to the nozzles, and
- a controller for moving the print head along a printing trajectory while changing the orientation of the print head, wherein the controller is arranged for:
- in a calibrating step moving the print head along a calibration trajectory, measuring ink pressures in the printing head and generating and storing ink pressure control data for the nozzles for different orientations of the print head, and
- in a printing step generating for varying orientations of the print head along the printing trajectory a pressure control signal on the basis of the stored ink pressure control data, which pressure control signal is supplied to the pump device such that a pressure of the ink in the nozzles is set at a predetermined pressure value.

In the calibrating step, the pressures in the printing head are measured as it moves with varying orientations along the calibrating trajectory at a given printing speed while applying a printing test pattern. In this way, the printing head pressures are recorded and pressure data are derived, such as a formula of a pressure curve or a look up table, for pressures that result in an optimal printing pattern for the prevailing print head orientations that will be encountered along the printing trajectory.

The print surface defining the printing trajectory of the print head may for instance be formed by a three-dimensional contoured surface of a vehicle, in particular of an airplane, such as a fuselage or a wing part. The calibration trajectory may be different from the printing trajectory and may include all prevailing print head orientations or may partly or wholly overlap or coincide with the printing trajectory.

In the calibration step, parameters of pressure control curves can be calculated for varying print head orientations. Alternatively, pressure control values may be determined and stored in the memory unit of the controller. The calibration trajectory may include all prevailing print head orientations, or may correspond to the printing trajectory. The pressure control data varies for the types of ink that are used and depend on ink density, viscosity and other rheological properties.

During the printing step, the pump device is controlled on the basis of pressure control signals that match the position and orientation of the print head along the print trajectory such that the pump device supplies ink to the print head nozzles at such pressures that the ink at the inflow openings of the nozzles is at a controlled printing pressure, which may be a substantially uniform pressure. In this way a repeatable and accurate high speed printing process (250 mm/s or higher) at high printing resolutions of over 1000 dpi is achieved for complex geometries.

In one embodiment of a printing device according to the invention, the print head comprises a pressure sensor for sensing ink pressures at the nozzles.

Providing a pressure sensor that is integrated in the print head, easily allows a calibration step to be carried out when new printing trajectories are used or when print settings such as types of ink or printing speeds, are changed. For large printing surfaces, the pressure sensors in the print head allow for a calibration step to be carried out during the printing process. By mounting the pressure sensors on the print head, the effects of the velocity and accelerations of the print head on the printing pressure are measured by the sensors and are automatically corrected.

The pressure sensor may comprise an inflow pressure sensor connected to an inflow end of the nozzles for sensing an inflow ink pressure at the nozzles. The controller may be configured such that the pump device supplies ink to the nozzles at the inflow pressure and is operated by inflow pressure control signals that are formed by $Pi=(A+K1)*f(\theta)+(B+K2)*g(\theta)$, wherein $f(\theta)$ and $g(\theta)$ are geometry factors depending on an angle $\theta$ of the print head with a horizontal direction, A is a distance from the pressor sensor to a print surface in a direction perpendicular to the print surface, B is a distance of the pressure sensor in a plane of the print surface and K1 and K2 are constants that are determined based on the properties of the ink and fluid hoses that are used.

Each jet of the print head is an opening where the ink contacts the atmosphere. If the ink is at too high of a pressure in the print head, then the ink will run out. Conversely, if ink is at too low of a pressure, then the print head will lose its prime and air will be aspirated into the jets. In a print system using a gravity feed setup, positive pressure is generated solely by gravity and pumps are used to pull a vacuum so that the ink pressure in the print head's jets are controlled to be exactly at ambient atmospheric pressure.

In another embodiment, the pressure sensor comprises a recirculation pressure sensor connected to a print head outlet that is situated on the opposite side of the array of nozzles from the inflow side. The pump device removes ink from an outlet of the print head at a recirculation pressure, and is operated by recirculation pressure control signals Pr that are formed by $Pr=(A+K3)*f(\theta)+(B+K4)*g(\theta)+X$. In this equation, K3 and K4 are constants and X is a difference between the inflow pressure and the recirculation pressure measured by the pressure sensors. The advantage of a recirculation print head is the consistent flow of ink past the nozzles, which is resupplied to the nozzles after firing. The constant flow of ink also prevents the ink from drying in the nozzles which could give rise to malfunction.

The pump's speed is controlled by an equation, such as the equation for Pr previously stated; this equation assumes a gravity fed ink system but could be adapted and used within a system that mechanically generates positive ink pressure. The equation considers both system properties such as ink chemistry, tubing material, and tube routing, as well as dynamic position of the print head relative to the pumps

BRIEF DESCRIPTION OF THE DRAWINGS

Some embodiments of a printing device and method of printing according to the invention will by way of non-limiting example be described in detail with reference to the accompanying drawings. In the drawings.

DETAILED DESCRIPTION OF THE INVENTION

Figure 1:
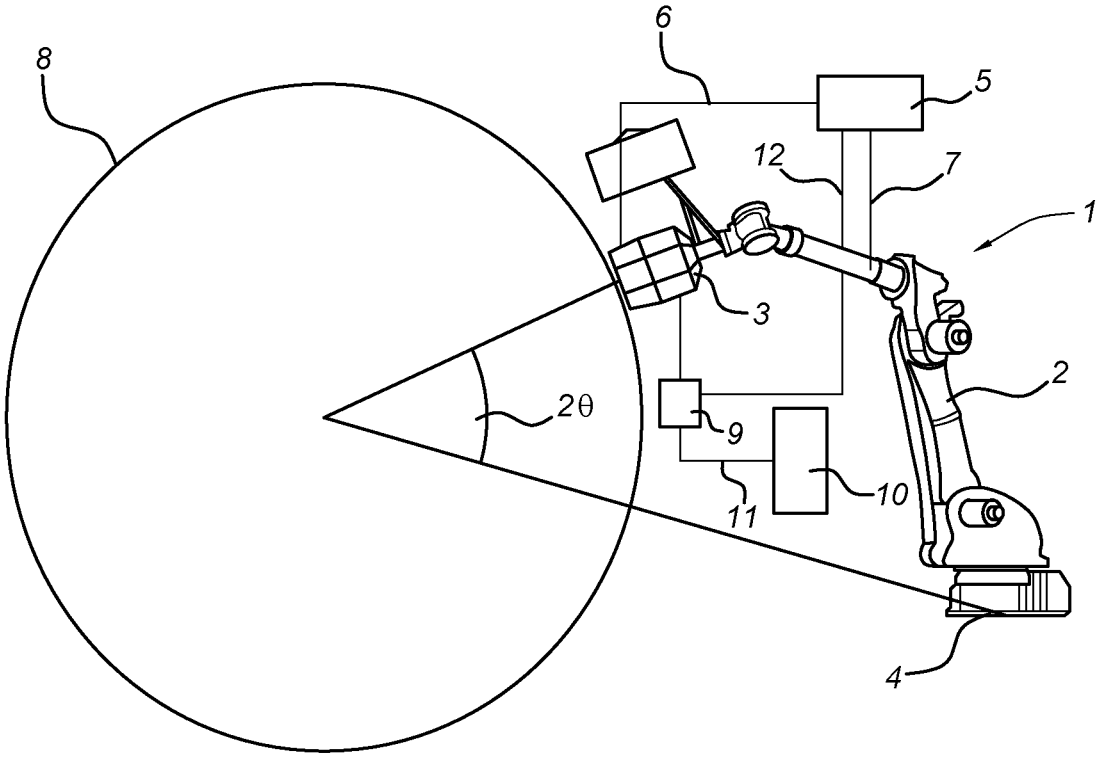
FIG. 1 shows a schematic overview of a printing device according to the invention.

FIG. 1 schematically shows a printing device 1 according to the invention with a robot arm 2 carrying a print head 3. The print head 3 may comprise an ink jet printer of type Fujifilm Dimatix Part Number SG1024LA-2C. The robot arm is placed on a movable support 4, for instance of the type described in U.S. patent application Ser. Nos. 16/015,240 and 16/015,243 filed on 22 Jun. 2018. Ink is supplied to the print head 3 from a bulk ink reservoir 10 via a pump 9 and an ink duct 11.

A controller 5 is with a print control line 6 connected to pressure sensors in the print head 3 for measuring ink pressures at the nozzles in the print head. The controller 5 is with an ink supply control line 12 connected to the pump 9 for controlling of the ink supply to the print head 3. The pump 9 of ink supply system may for instance comprise a low flow recirculation supply system of the type LC-LFR as available from the company Megnajet, Northampshire, United Kingdom.

The controller 5 is via a control line 7 connected to the robot arm 2 for controlling the position of the robot arm 2 and the speed and orientation of the print head 3 along a contoured three-dimensional print surface 8, which has by way of example been shown as a circle but in practise will be of a complex geometry, such as the outer surface of an aeroplane.

Figure 2:
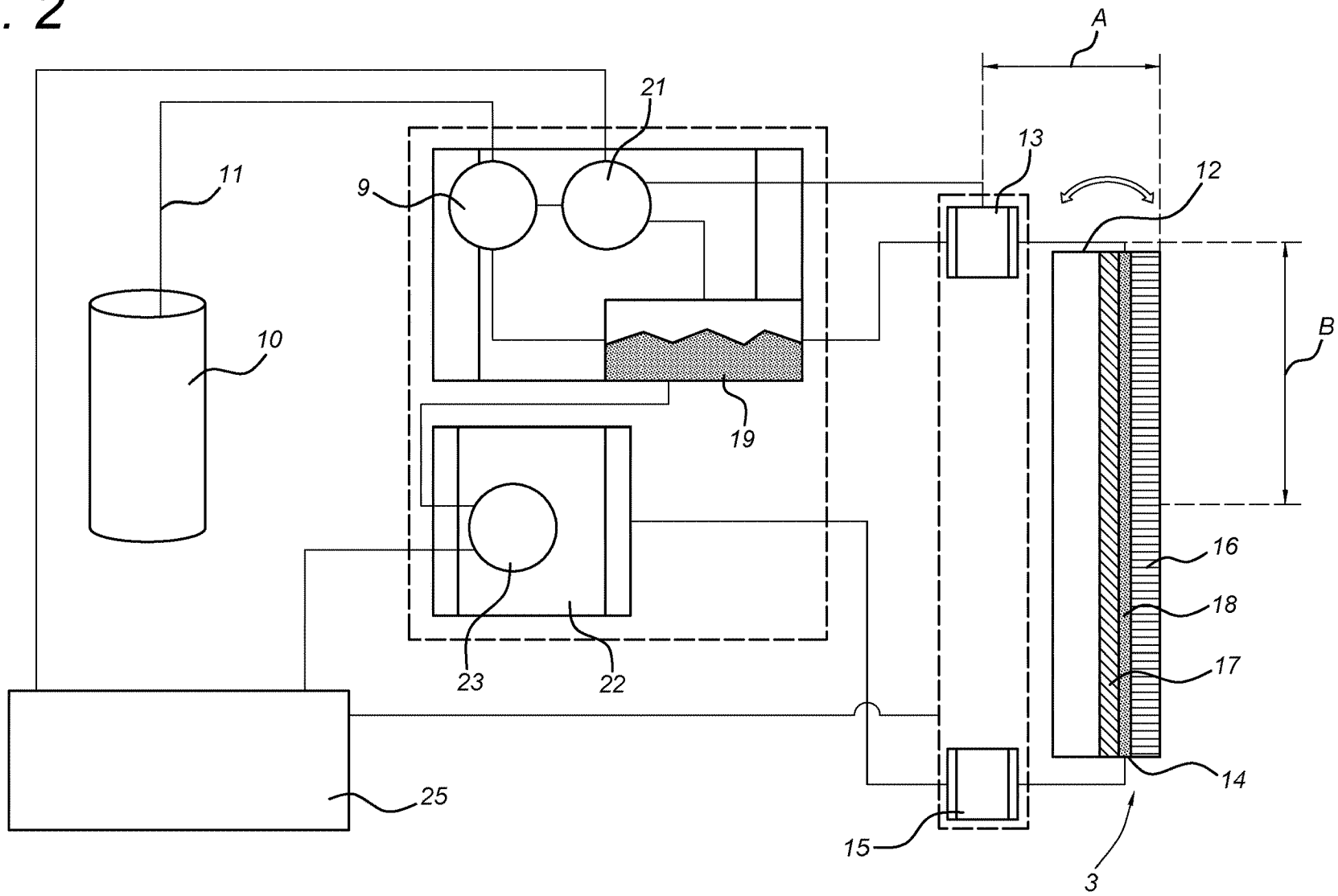
FIG. 2 shows a schematic lay-out of the printing head and the pressure control unit of the present invention.

The controller 5 can be made up of several dedicated and spatially distributed control units, such a meniscus pressure control unit 21, a recirculation pressure control unit 22 and a control module 25 as shown in FIG. 2, for controlling of the robot arm 2, the print head operation and the ink supply.

FIG. 2 shows a schematic overview of the print head 3 with a nozzle array 16 that is with an inlet 12 connected to a meniscus pressure sensor 13. An outlet 14 of the nozzle array 16 is connected to the a recirculation pressure sensor 15. The nozzles in the array 16 are each provided with a piezo element 17 for expelling the ink 18 that flows along the nozzles, from the nozzles in the form of small droplets.

From an ink reservoir 19, ink flows into the inlet 12 of the nozzle array 16 at the meniscus pressure Pi and is transported along all nozzles to fill each nozzle with ink. Ink is supplied to the ink reservoir 19 from the bulk ink reservoir 10 by the fill pump 9. The fill pump 9 is controlled by meniscus pressure control unit 21.

At the outlet 14 of the nozzle array 16, the recirculation pressure of the ink flowing along the filling apertures of the nozzles is smaller than the meniscus pressure by a set pressure difference, 50 mbar, so that ink flows back from the outlet 14 back to the ink reservoir 19, via a recirculation pressure control unit 22. The recirculation pressure control unit 22 comprises a recirculation pump 23 that is controlled at recirculation pressures Pr as described below.

In order to operate the nozzle array 16 at a defined meniscus pressure Pi at its inlet 12, and at a defined recirculation pressure Pr at its outlet 14, the fill pump 9 is controlled by pressure curves that are generated in controller unit 25. The pressure curves are generated based on positional data of the print head 3 and prevailing pressures at these positions, in a calibration step in which the print head 3 is moved by the robot arm 2 along a calibration printing trajectory at the required speed. During the calibration step, industry standard gradient patterns are printed and measurements are taken so that the meniscus pressures Pi and recirculation pressures Pr are tuned for consistent printed graphics across all orientations of the print head 3 for all types of ink that are used.

The result of the calibration step are pressure curves for the meniscus pressure Pi and the recirculation pressure Pr for any possible print head orientation for any type of ink that will be used in the printing step. Because the print head 3 is in motion when printing, accelerations are felt by the print head immediately prior to and possibly during printing. The pressure equations for the inlet pressure Pi and the recirculation pressure Pr are not dependant on these velocities and accelerations due to the location of the pressure sensors. If an acceleration is felt by the print head 3, the pressure sensors will detect a higher or lower pressure in the ink. This pressure change will be fed back to the inlet and recirculation pumps, which will vary their speed in order to bring the ink back to the commanded pressures Pi and Pr.

The curves that control the inlet pressure Pi and the recirculation pressure Pr are defined by:

$$Pi=(A+K1)*C*D*\sin(90°-e)+(B+K2)*C*D*\mathrm{Cos}(90°-e)$$

$$Pr=(A+K3)*C*D**\sin(90°-e)+(B+K4)*C*D*\mathrm{Cos}(90°-e)-X$$

Herein is:

A: a distance from the pressure sensors 13, 15 in the print head 3 to the print surface 8 in the direction that is normal to the print surface 8, in inches B: a distance from the pressure sensors 13,15 in the print head 3 to the print surface 8 in the direction parallel to the print surface, in inches C: a conversion factor from inches of water to mbar D: the density of the ink in $g/cm^3$ θ: the print head angle K1,K2,K3,K4: constants that are set for each specific ink that is used and the properties of the ink ducts. The constants account for differences in ink viscosity, pressure losses due to bends in the ink ducts and due to friction in the ducts.

X: the set difference between the inlet pressure Pi and the recirculation Pressure Pr in mbar.

The values for Pi and Pr are positive numbers that represent vacuum values, i.e. the magnitude below ambient atmospheric pressure. The print head orientation resulting in the values A and B can be calculated in the controller 5 by reading the positions of the robot arm 7 and deriving therefrom the orientation of the print surface 8. The orientation of the print head 3 may also be derived by directly reading into the controller 5, the gravity vector from an Inertial Measurement Unit (IMU) on the print head 3 or other sensors mounted near the print surface 8. The measurement rate of the print head angle θ and hence of the update of the calculated pressure set point values Pi and Pr should preferably at least be equal to 20 kHz.

An example of pressure curves Pi and Pr is as follows:

A=3.00 inches

B=2.25 inches

C=0.402 mbar/inch-water

D=0.800 $g/cm^3$

θ=80.0 degrees (i.e. the print head will print toward a wall, but is pointed slightly down towards the floor)

K1=0.250 inch

K2=−0.250 inch

K3=−0.500 inch

K4=0.500 inch

X=50 mbar

Pi=(3.00+0.250)*0.402*0.800*sin(90°−80.0°)+(2.25+−0.250)*0.402*0.800*cos(90°−80.0°)=5.04 mbar Pr=(3.00+−0.500)*0.402*0.800*sin(90°−80.0°+(2.25+0.500)*0.402*0.800*cos(90°−80.0°)−50=50.3 mbar

The invention claimed is:

1. Printing device comprising:

a movable robot arm mounted on a movable support, a print head supported at a printing end of the robot arm, the print head comprising a plurality of nozzles, an ink reservoir connected to the nozzles of the print head and to a pump device for supplying ink from the reservoir to the nozzles, and a controller for moving the print head along a printing trajectory while changing the orientation of the print head, wherein the controller is arranged for:

in a calibrating step moving the print head along a calibration trajectory and measuring ink pressures in the printing head and generating and storing ink pressure control data for the nozzles for different orientations of the print head, and in a printing step generating for varying orientations of the print head along the printing trajectory a pressure control signal on the basis of the stored ink pressure control data, which pressure control signal is supplied to the pump device such that a pressure of the ink in the nozzles is set at a predetermined pressure value.

2. Printing device according to claim 1, wherein at least a part of the calibration trajectory corresponds with the printing trajectory.

3. Printing device according to claim 1 or 2, wherein the print head comprises a pressure sensor.

4. Printing device according to claim 3, wherein the pressure sensor comprises an inflow pressure sensor connected to an inflow end of the nozzles for sensing an inflow ink pressure at the nozzles.

5. Printing device according to claim 4, wherein the pump device supplies ink to the nozzles at the inflow pressure and is operated by inflow pressure control signals that are formed by pi=(A+K1)*f(θ)+(B+K2)*g(θ), wherein f(θ) and g(θ) are geometry factors depending on an angle θ of the print head with a horizontal direction, A is a distance from the pressor sensor to a print surface in a direction perpendicular to the print surface, B is a distance of the pressure sensor in a plane of the print surface and K1,K2 are constants.

6. Printing device according to claim 4, wherein the pressure sensor comprises a recirculation pressure sensor connected to an outflow end of the print head for measuring a recirculation pressure.

7. Printing device according to claim 6, wherein the pump device removes ink from an outlet of the print head at a recirculation pressure, and is operated by recirculation pressure control signals Pr that are formed by Pr=(A+K3)*f(θ)+(B+K4)*g(θ)+X wherein f(θ) and g(θ) are geometry factors depending on an angle θ of the print head with a horizontal direction, A is a distance from the pressor sensor to a print surface in a direction perpendicular to the print surface, B is a distance of the pressure sensor in a plane of the print surface, K3,K4 are constants and X is a difference between the inflow pressure and the recirculation pressure measured by the pressure sensors.

8. Method of printing an object with a movable robot arm mounted on a movable support, a print head supported at a printing end of the robot arm, the print head comprising a plurality of nozzles, a pressure sensor for sensing an ink pressure in the nozzles and forming ink pressure signals, an ink reservoir connected to the nozzles of the print head and to a pump device for supplying ink from the reservoir to the nozzles, the method comprising:

carrying out a calibration step by:

moving the print head along a calibrating trajectory with varying orientations, measuring a pressure of the ink at the nozzles along the calibrating trajectory with the pressure sensor and deriving pressure control data from the ink pressure signals and storing the pressure control data in a memory unit of a print controller, and carrying out a printing step by:

moving the print head along a printing trajectory and controlling the pump device by retrieving the pressure control data from the memory unit and generating pressure control signals at the corresponding printing head orientations along the printing trajectory such that the ink in the nozzles is at a predetermined ink pressure.

9. Method according to claim 8, wherein the calibration trajectory at least partly corresponds with the printing trajectory.

10. Method according to claim 8, wherein the pressure sensor comprises an inflow pressure sensor for sensing an ink pressure at the nozzles, wherein the pump device supplies ink to the nozzles at the inflow pressure and is operated by inflow pressure control signals that are formed by pi=

$(A+K1)*f(\theta)+(B+K2)*g(\theta)$, wherein A is a distance from the pressor sensor to a print surface in a direction perpendicular to the print surface, and B is a distance of the pressure sensor in a plane of the print surface, K1,K2 are constants.

11. Method according to claim 10, wherein the pressure sensor comprises a recirculation pressure sensor connected to an outflow end of the print head, a recirculation pump device removing ink from the print head at a recirculation pressure, the method comprising the step of operating the recirculation pump device by recirculation pressure control signals Pr that are formed by $Pr=(A+K3)*f(\theta)+(B+K4)*g(\theta)+X$ wherein A is a distance from the pressor sensor to a print surface in a direction perpendicular to the print surface, and B is a distance of the pressure sensor in a plane of the print surface, K3,K4 are constants and X is a difference between the inflow pressure and the recirculation pressure.

12. Method according to claim 8, wherein the object to be printed is part of an aeroplane.

* * * * *